US006244843B1

(12) United States Patent
Kosuge

(10) Patent No.: US 6,244,843 B1
(45) Date of Patent: Jun. 12, 2001

(54) INTERNAL GEAR PUMP

(75) Inventor: Toshiyuki Kosuge, Itami (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 09/486,824

(22) PCT Filed: Sep. 2, 1998

(86) PCT No.: PCT/JP98/03947

§ 371 Date: May 9, 2000

§ 102(e) Date: May 9, 2000

(87) PCT Pub. No.: WO99/11935

PCT Pub. Date: Mar. 11, 1999

(30) Foreign Application Priority Data

Sep. 4, 1997 (JP) ..... 9-239562

(51) Int. Cl.[7] ..... F04C 2/10
(52) U.S. Cl. ..... 418/150; 418/171
(58) Field of Search ..... 418/150, 166, 418/171

(56) References Cited

U.S. PATENT DOCUMENTS 5,876,193 * 3/1999 Hosono et al. ..... 418/150

FOREIGN PATENT DOCUMENTS

3938346 C1 4/1991 (DE) .
4200883 C1 4/1993 (DE) .
233423 5/1925 (GB) .
5-256268 10/1993 (JP) .

* cited by examiner

*Primary Examiner*—John J. Vrablik
(74) *Attorney, Agent, or Firm*—McDermott, Will & Emery

(57) ABSTRACT

An internal gear pump which improves the mechanical efficiency and the life and reduces noises by eliminating non-uniformity of the gaps between teeth. In the internal gear pump wherein the tooth spaces of the outer gear and the tooth tips of the inner gear form an epicycloid and the tooth tips of the outer gear and the tooth spaces of the inner gear form a hypocycloid, these cycloids are formed by four circles that roll on the pitch circle of each gear such that the gap between teeth in a region where the outer and inner gears mesh most deeply with each other is substantially equal to the gap between teeth in a region where the depth of mesh between the outer and inner gears are the shallowest.

1 Claim, 4 Drawing Sheets

INTERNAL GEAR PUMP

TECHNOLOGICAL FIELD

The present invention relates to a rotary pump driven by a driving source such as a motor for compressing and discharging liquid or gas, and particularly an internal gear pump suitable for use as a liquid pump.

BACKGROUND TECHNOLOGY

Most internal gear pumps used in vehicle transmissions by internal combustion engines and automatic motors use trochoidal teeth. With trochoidal teeth, the tooth surface of one of the outer and inner gears is arcuately defined while the tooth surface of the other gear is defined by non-slip rotation of the arcuately defined teeth of the one gear.

The internal gear pump according to the present invention uses a cycloidal tooth profile to discharge liquid or gas in an internal combustion engine or an automatic transmission. Such a pump is described in e.g. U.K. patent 233423 and German patent 3938346. The pump of the German patent is an internal gear pump having an outer gear (outer rotor) and an inner gear (inner rotor) having different numbers of teeth from each other. It takes advantage of excellent kinematics properties of teeth and tooth spaces having a perfect cycloidal tooth profile.

The teeth of the outer gear mesh with those of the inner gear driven by an engine crankshaft or the main shaft (spindle) of an automatic gear box. In this internal gear pump, relatively clear radial movement of e.g. the crankshaft as the drive shaft is compensated for by providing a suitable clearance between the periphery of the outer gear and the housing (i.e. providing a play that allows radial runout of the outer gear). For such compensation, the outer gear may be mounted with substantially no play but providing a correspondingly large play between the inner gear and a bearing of the inner gear. In this case, the inner gear teeth and the outer gear teeth are brought into mesh with each other. The concept of the present invention is suitably applicable to this type of pump.

FIG. 4 is a model view of a flattened cycloidal tooth profile proposed in unexamined Japanese patent publication 5-256268.

In the publication, in order to reduce noises resulting from pulsation of a discharge flow, drop in the pump efficiency, and cavitation noises, as observed in known pumps, the cycloidal tooth profile of each gear is flattened to reduce the gap between teeth at the portion where the outer and inner gears mesh most deeply with each other. In FIG. 4, fh represents an original epicycloid which is formed by the locus of a point on the circumference of a circle re when the circle rolls on a pitch circle P from the point z0, fr represents an original hypocycloid which is formed by the locus of a point on the circumference of a circle rh when the circle rolls on a pitch circle P from the point z0, while fh3 and rh3 represent an epicycloid and a hypocycloid after flattening, respectively.

Pressure pulsation of a hydraulic fluid, i.e. pulsation of discharge flow applies a vibrating force to the inner and outer gears, thus causing the teeth of these gears to collide against each other in radial and tangential directions, thus producing undesirable noises.

In unexamined Japanese patent publication 5-256268, trials are made to suppress such noises. But in the solution of this publication, the gap between teeth is extremely small at a portion where the outer and inner gears mesh most deeply with each other, and large at a portion where the depth of mesh between the gears is the shallowest. Thus, the gap is not uniform. This means that when pulsation of discharge flow occurs, the teeth of the gears tend to collide against each other at a portion where the depth of mesh between the outer and inner gears is the deepest. Noise suppression is thus not satisfactory.

Further, pointed tips (z1 and z2 in FIG. 4) are formed in the tooth profile. Such pointed tips tend to be chipped, increase the surface pressure represented by Hertzian stress, and promote wear of the tooth surface.

Discharge pulsation is not the only cause of these phenomena. In an ordinary internal gear pump, runout of the drive shaft coupled with the inner gear also causes noises and wear. Since the runout of the drive shaft is transmitted directly to the inner gear, this means that a vibrating force acts on the inner gear. Due to non-uniformity of the gaps between teeth, the teeth of the inner and outer gears tend to collide against each other.

Further, in the structure in which the gear teeth tend to collide against each other, a marked increase in the pulsation of discharge flow due to cavitation resulting from collapse of liquid or gas bubbles in the pumping chamber tends to promote such collision between gear teeth and thus increase noise and wear of tooth surface.

An object of the present invention is to provide an internal gear pump which can reduce noises and improve the mechanical efficiency and the life.

DISCLOSURE OF THE INVENTION

The gear pump according to the present invention is an internal gear pump used as a force feed pump for liquid or gas, and characterized by the following structure.

In an internal gear pump comprising an outer gear, an inner gear mounted in the outer gear and meshing with the outer gear, and a housing in which the outer and inner gears are mounted, wherein the tooth spaces of the outer gear and the opposing tooth tips of the inner gear form an epicycloid, while the tooth tips of the outer gear and the opposing tooth spaces of the inner gear form a hypocycloid, characterized in that the epicycloid of the outer gear is formed by the locus of a point on the circumference of a first circle that rolls on the pitch circle of the outer gear, that the epicycloid of the inner gear is formed by the locus of a point on the circumference of a second circle that rolls on the pitch circle of the inner gear, that the hypocycloid of the outer gear is formed by the locus of a point on the circumference of a third circle that rolls on the pitch circle of the outer gear, that the hypocycloid of the inner gear is formed by the locus of a point on the circumference of a fourth circle that rolls on the pitch circle of the inner gear, that the first to fourth circles have different radii from any other circles, the gap between the tooth tip of the outer gear and the opposing tooth space of the inner gear being substantially equal to the difference in diameter between the third and fourth circles, while the gap between the tooth space of the outer gear and the opposing tooth tip of the inner gear being substantially equal to the difference in diameter between the first and second circles, and that the gap between the outer and inner gears at a portion where the outer and inner gears mesh most deeply with each other being substantially equal to the gap between tooth tips of the outer and inner gears at a portion where the depth of mesh between the outer and inner gears is the shallowest.

According to the present invention, the gap between teeth at a portion where the outer and inner gears mesh most deeply with each other is substantially equal to the gap between teeth in a region where the depth of mesh between the outer and inner gears is the shallowest. This improves compression efficiency and life and reduce noises and wear of the tooth flanks.

SIMPLIFIED EXPLANATION OF THE DRAWINGS

BEST MODE FOR EMBODYING THE INVENTION

Figure 1:
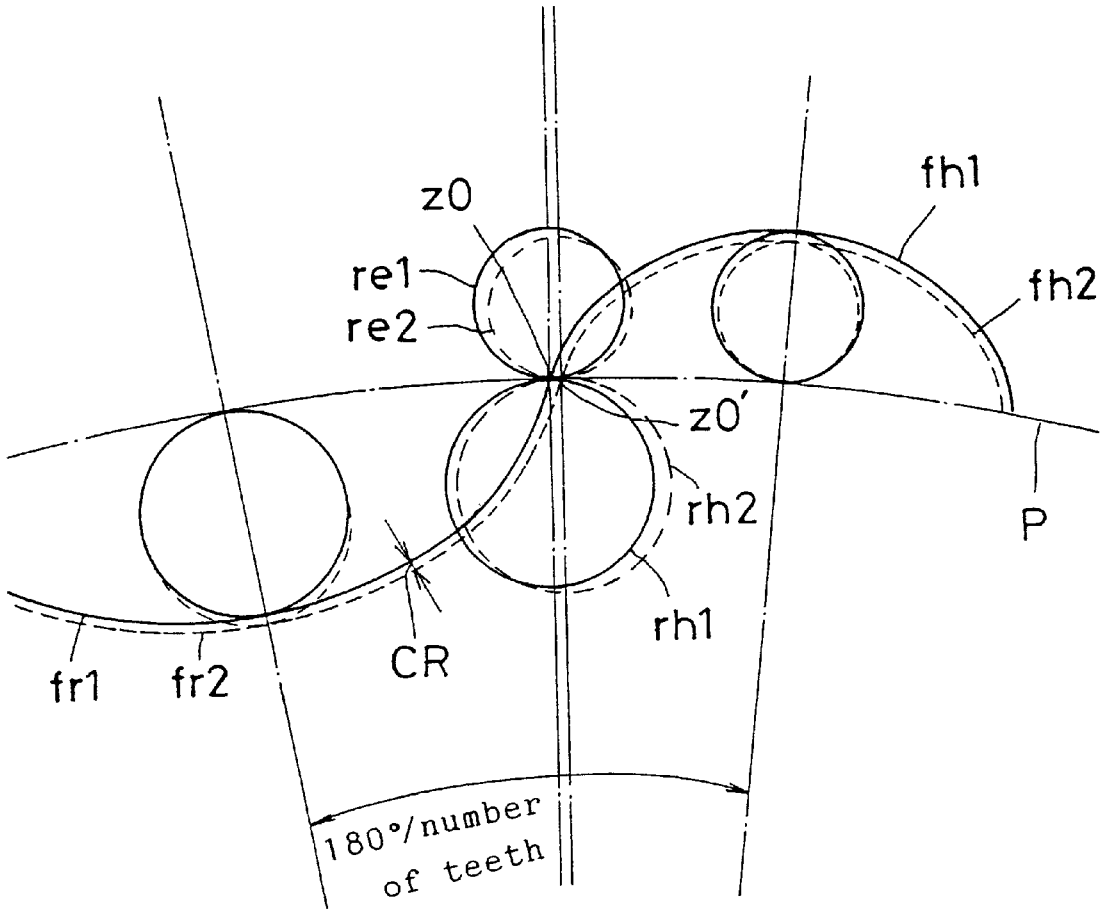
FIG. 1 is a view showing the loci of mesh between the inner and outer gears of the pump according to the present invention.

FIG. 1 shows a preferred embodiment of the present invention. fh1 and fr1 show an epicycloid and a hypocycloid, respectively, defining the shapes of tooth spaces 3 and tooth tips 4 of an outer gear 1 shown in FIG. 2. fh1 is formed as the locus of a point on the circumference of a generated circle re1 when the circle re1 rolls on a pitch circle P from a point z0 on the pitch circle. Similarly, fr1 is formed as the locus of a point on the circumference of a generated circle rh1 when the circle rh1 rolls on the pitch circle P from the point z0 on the pitch circle.

fh2 and fr2 represent an epicycloid and a hypocycloid, respectively, defining the shapes of the tooth tips 6 and tooth spaces 5 of the inner gear 2 shown in FIG. 2. fh2 is formed as the locus of a point on the circumference of a circle re2 when the circle re2 rolls on the pitch circle P from a point z0' on the pitch circle. Similarly, fr2 is formed as the locus of a point on the circumference of a circle rh2 when the circle rh2 rolls on the pitch circle P from the point z0' on the pitch circle.

The pitch circle P represents the respective pitch circles of the outer and inner gears 1, 2 shown in FIG. 2. But in FIG. 1, they are shown as one common pitch circle for convenience sake. Since a gap CR between the outer and inner gears 1 and 2 is created by the difference in diameter among the circles re1, re2, rh1, rh2, substantially equal gaps are formed between the outer gear 1 and the opposing inner gear 2 in the region where they mesh most deeply with each other.

Figure 3:
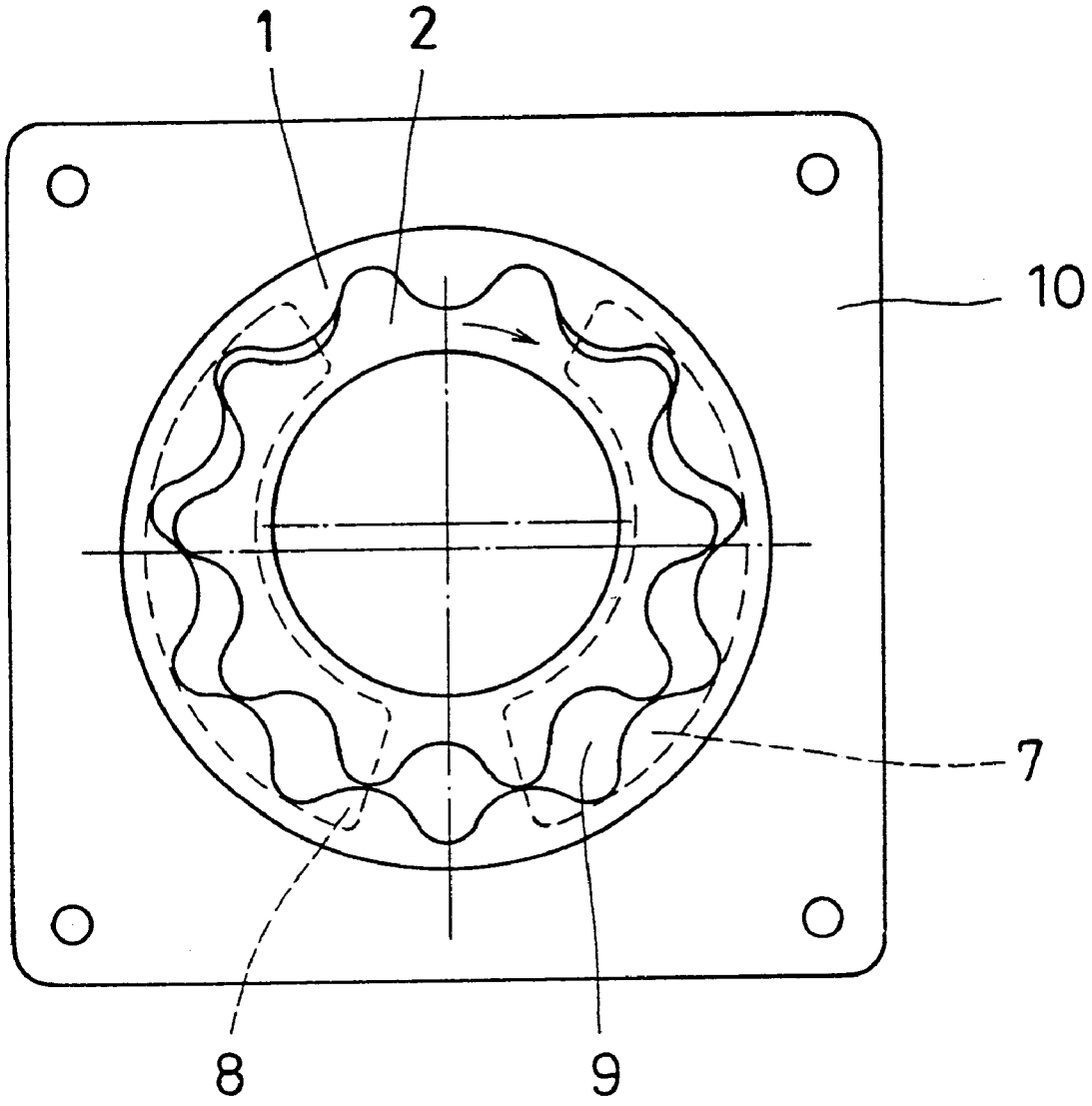
FIG. 3 is a front view of the internal gear pump of the present invention with the lid of the housing removed.
Figure 4:
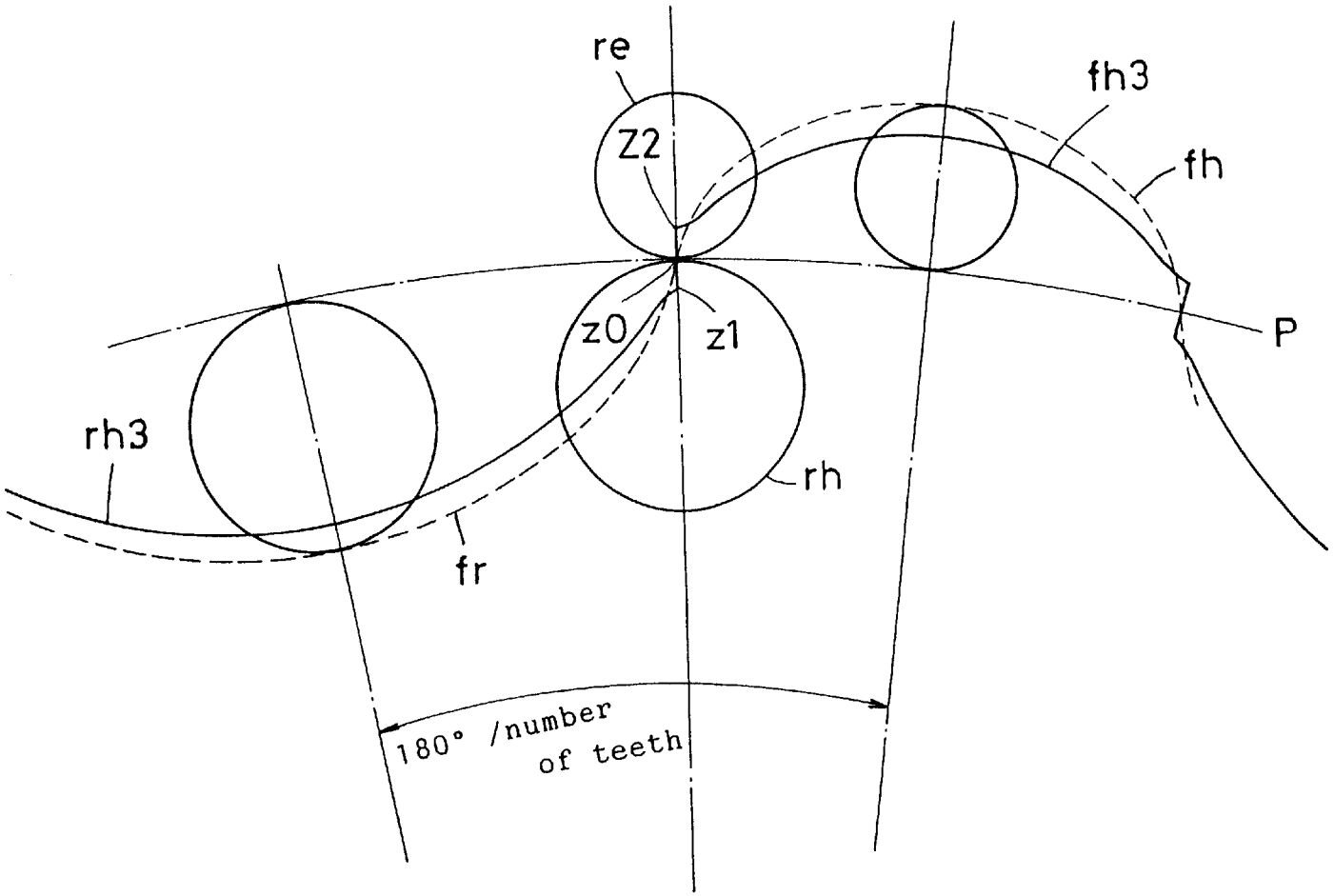
FIG. 4 is a model view of a flattened cycloidal tooth profile.

As shown in FIG. 3, the internal gear pump of the present invention comprises an outer gear 1 and an inner gear 2 having a smaller number of teeth than the outer gear. The gears 1, 2 are mounted in a housing 10 (whose lid is not shown). The inner gear 2 has its center of rotation offset from that of the outer gear 1, and is driven by a drive shaft (not shown) provided coaxially with the inner gear 2. The housing 10 has an inlet port 7 and a discharge port 8 like an ordinary pump housing. Defined between the inner gear 2 and the outer gear 1 is a chamber (pumping chamber) 9 that changes in volume as the gears rotate. Liquid or gas is drawn into the chamber 9 at a portion where the chamber 9 communicates with the inlet port 7. The liquid or gas drawn into the chamber is compressed therein and discharged through the discharge port 8.

Ordinarily, while a rotary pump is in operation, the drive shaft tends to run out due to manufacturing errors. The runout of the drive shaft is transmitted directly to the inner gear 2, and then to the outer gear 1 which is in mesh with the tooth surface of the inner gear 2. The runout of the drive shaft causes a shift from a theoretical mesh between the gears. This may cause unexpected wear of the teeth of the gears, and increase noises due to collision of the teeth of the gears. Further, the outer gear 1 might be pressed mechanically against the housing 10. In the worst case, the gears may be broken.

Therefore, in the prior art, in order to solve these problems resulting from non-uniformity of gaps between teeth of the gears, it was necessary to minimize runout of the drive shaft by manufacturing with high tolerance or to increase the gap between the outer gear 1 and the housing 10.

But an attempt to increase the gap between the outer gear 1 and the housing 10 is nothing but reducing the pump discharge rate, because when the gears rotate and the volume of the chamber 9 decreases, compressed fluid flows in reverse from the high-pressure portion to low-pressure one through the gap.

According to the present invention, in order to eliminate non-uniformity of the gaps between teeth, the gap between teeth of the gears in a region where the outer and inner gears 1, 2 mesh most deeply with each other is substantially equal to the gap between teeth of the gears in a region where the depth of mesh between the outer and inner gears is the shallowest.

Needless to say, the uniformity of the gap between teeth is achieved by providing suitable differences in diameter of four circles.

As a result, it is possible to form a smooth tooth profile without impairing continuity of the tooth profile, namely without developing any pointed tip on the tooth profile, thereby preventing wear of the tooth surface starting from a pointed tip.

According to the present invention, the uniformity of the gap between teeth and the continuity of the tooth profile are assured not depending on the numbers of teeth of the inner and outer gears 2, 1, the diameters of the epicycloid- and hypocycloid-generating circles, and their ratio. The amount (or size) of the gap between teeth should be selected according to the required discharge rate of the pump.

Figure 2A:
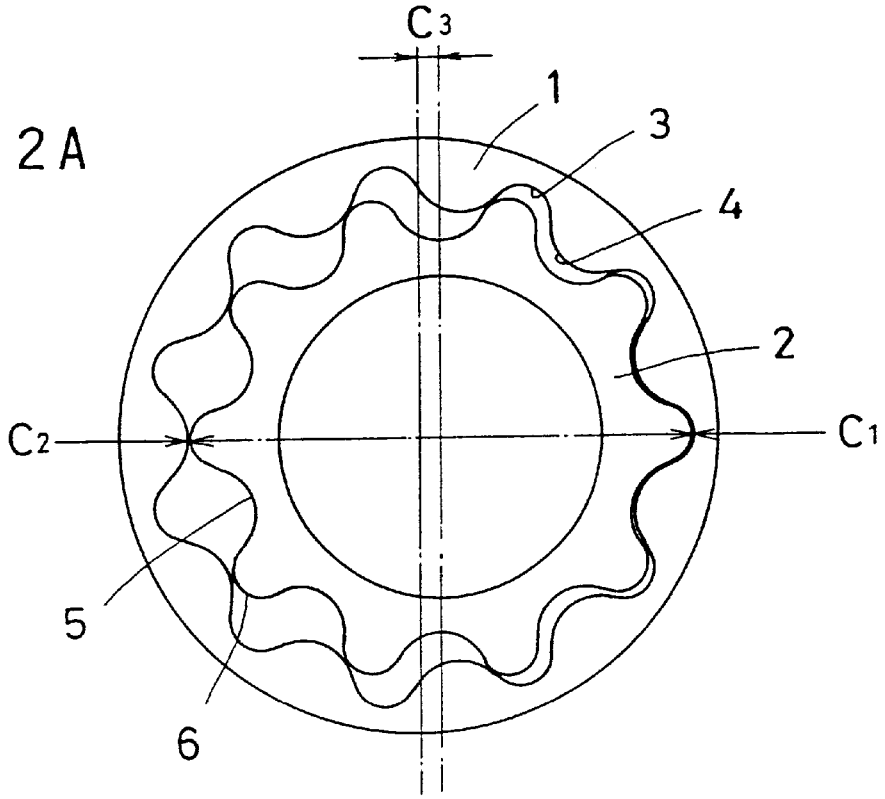
FIGS. 2A and 2B are front views showing how the inner and outer gears of the internal gear pump of the present invention mesh with each other.
Figure 2B:
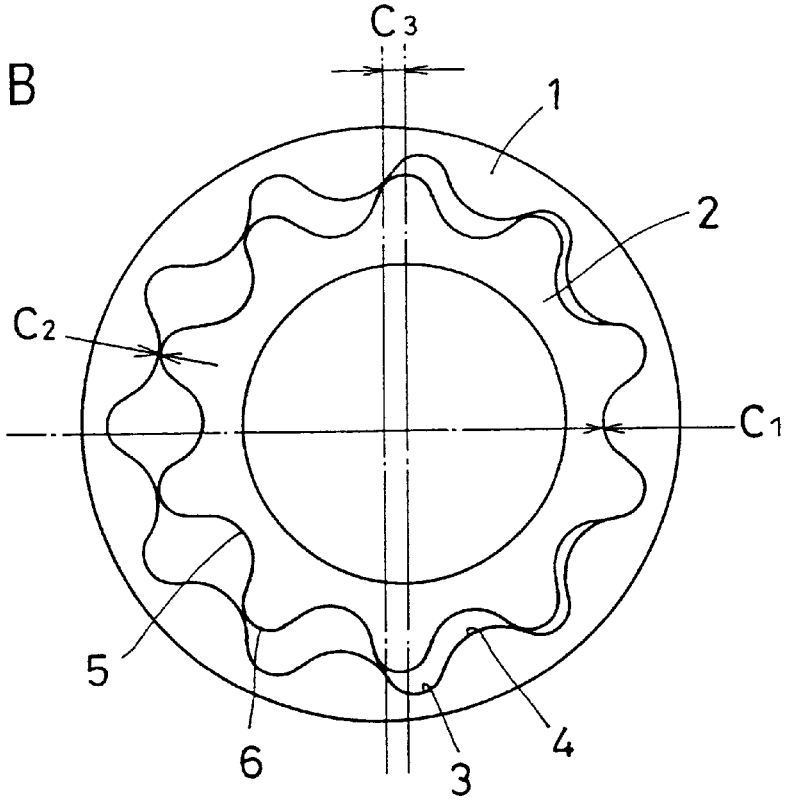

FIGS. 2A and 2B show how in the internal gear pump of the present invention the gears mesh. FIG. 2A shows a state in which a tooth tip 6 of the inner gear 2 meshes most deeply with a tooth space 3 of the outer gear 1. FIG. 2B shows a state in which the tooth space 5 of the inner gear 2 meshes most deeply with the tooth tip 4 of the outer gear 1.

The outer gear is designated by numeral 1 the inner gear by 2, the tooth spaces and tooth tips of the outer gear by 3 and 4, and the tooth spaces and tooth tips of the inner gear by 5 and 6. C1 indicates the gap between the tooth tip 6 of the inner gear 2 and the tooth space 3 of the outer gear 1 at the deepest mesh point, C2 indicates the gap between the tooth tips of the outer gear 1 and the inner gear 2 at the shallowest mesh point (located diametrically opposite the deepest mesh point), and C3 indicates the amount of offset between the centers of rotation of the outer gear 1 and the inner gear 2.

The following are typical dimensional data of the inner and outer gears of the pump according to the present invention.

Number of teeth of the inner gear: 10

Diameter of pitch circle of the inner gear: 64.00 mm

Diameter of the epicycloid-generating circle of the inner gear: 2.50 mm

Diameter of the hypocycloid-generating circle of the inner gear: 3.90 mm

Number of teeth of the outer gear: 11

Diameter of the pitch circle of outer gear: 70.40 mm

Diameter of the epicycloid-generating circle of the outer gear: 2.56 mm

Diameter of the hypocycloid-generating circle of the outer gear: 3.84 mm

Amount of offset between the centers of rotation of the inner and outer gears: 3.20 mm The tooth profile having the above dimensions was formed and its gaps were measured. The gap between teeth at the deepest mesh point (C1 in FIGS. 2A and 2B) was about 0.06 mm, while the gap between teeth at the shallowest mesh point (C2 in FIGS. 2A and 2B) was about the same as the former, i.e. about 0.06 mm.

In a partial enlarged view, one can see that the tooth profile is continuous without producing pointed tips at the starting or terminating points of the epicycloid and hypocycloid.

FIG. 3 shows the internal gear shown in FIGS. 1 and 2 mounted in a housing. In the figure, numeral 7 designates the inlet port, 8 the discharge port, 9 the chamber, and 10 the housing. The housing has a cover (not shown) for sealing the chamber in which the gears are mounted.

As a result of tests on specimens, it was found out that the internal gear pump of the present invention is drastically improved in life and mechanical efficiency in comparison with conventional pumps of the same type.

What is claimed is:

1. An internal gear pump comprising an outer gear, an inner gear mounted in said outer gear and meshing with said outer gear, and a housing in which said outer and inner gears are mounted, wherein the tooth spaces of said outer gear and the opposing tooth tips of said inner gear form an epicycloid, while the tooth tips of said outer gear and the opposing tooth spaces of said inner gear form a hypocycloid, characterized in that the epicycloid of said outer gear is formed by the locus of a point on the circumference of a first circle that rolls on the pitch circle of said outer gear, that the epicycloid of said inner gear is formed by the locus of a point on the circumference of a second circle that rolls on the pitch circle of said inner gear, that the hypocycloid of said outer gear is formed by the locus of a point on the circumference of a third circle that rolls on the pitch circle of said outer gear, that the hypocycloid of said inner gear is formed by the locus of a point on the circumference of a fourth circle that rolls on the pitch circle of said inner gear, that said first to fourth circles have different radii, the gap between the tooth tip of said outer gear and the opposing tooth space of said inner gear being substantially equal to the difference in diameter between said third and fourth circles, while the gap between the tooth space of said outer gear and the opposing tooth tip of said inner gear being substantially equal to the difference in diameter between said first and second circles, and that the gap between the outer and inner gears at a portion where said outer and inner gears mesh most deeply with each other being substantially equal to the gap between tooth tips of said outer and inner gears at a portion where the depth of mesh between said outer and inner gears is the shallowest.

* * * * *